US005247862A

United States Patent [19]

Haack

[11] Patent Number: 5,247,862

[45] Date of Patent: Sep. 28, 1993

[54] PROCESS FOR PRODUCING BURR-FREE WORKPIECES BY BLANKING, IN PARTICULAR IN A COUNTERBLANKING TOOL

[75] Inventor: Johannes Haack, Studen, Fed. Rep. of Germany

[73] Assignee: Feintool International Holding, Lyss, Switzerland

[21] Appl. No.: 585,665

[22] Filed: Sep. 19, 1990

[30] Foreign Application Priority Data

Sep. 20, 1989 [DE] Fed. Rep. of Germany ..... 3931320

[51] Int. Cl.[5] ..... B27F 1/14; B21D 45/08; B21D 28/16

[52] U.S. Cl. ..... 83/27; 83/55; 83/124; 83/128; 83/137

[58] Field of Search ..... 83/50, 55, 124, 125, 83/128, 137, 555, 622, 639.5, 685, 695, 27, 140

[56] References Cited

U.S. PATENT DOCUMENTS

| | | | |
|---|---|---|---|
| 2,970,503 | 2/1961 | Chevalier | 83/128 |
| 3,119,293 | 1/1964 | Allen et al. | 83/140 |
| 3,564,959 | 2/1971 | Harada | 83/124 |
| 3,570,343 | 3/1971 | Wolnosky et al. | 83/124 |
| 3,583,266 | 6/1971 | Kondo | 83/55 |
| 3,611,854 | 10/1971 | Gilev et al. | 83/140 |
| 3,739,669 | 6/1973 | Seki | 83/137 |
| 3,878,746 | 4/1975 | Carmeli | 83/137 |
| 4,477,537 | 10/1984 | Blase et al. | 83/55 |
| 4,662,256 | 5/1987 | Hicks | 83/125 |
| 4,905,556 | 3/1990 | Haack et al. | 83/137 |

FOREIGN PATENT DOCUMENTS

| | | | |
|---|---|---|---|
| 1177986 | 4/1959 | France | 83/125 |
| 1171154 | 8/1985 | U.S.S.R. | 83/124 |

*Primary Examiner*—Hien H. Phan
*Attorney, Agent, or Firm*—Bachman & LaPointe

[57] ABSTRACT

The present invention relates to a process and a device for producing burr-free workpieces by blanking using a counterblanking tool. The counterblanking tool has an upper tool and a lower tool which include respectively an upper blanking die and a lower blanking die and an upper punch and a lower punch. The counterblanking tool further includes a ram plate which moves one of the upper and lower tools towards the other of the upper and lower tools. The ram plate moves in a continuous ram stroke during which a blanking strip from which a workpiece is to be blanked is clamped between the upper and the lower tool. During the initial portion of the blanking operation, the blanking dies remain in place while a first one of the punches, travels further and a second one of the punches travels back until a limit stop is reached. During this travel the first punch cuts partly into the blanking strip. After movement of the punches is stopped, one of the blanking dies travels against the limit stop and pushes the other of said blanking dies so that the dies slide along the punches and the second one of the punches cuts the workpiece out from the blanking strip. Thereafter the ram stroke is stopped and reversed so that the tools are separated and the workpiece is pushed out of the counterblanking tool.

8 Claims, 4 Drawing Sheets

PROCESS FOR PRODUCING BURR-FREE WORKPIECES BY BLANKING, IN PARTICULAR IN A COUNTERBLANKING TOOL

BACKGROUND OF THE INVENTION

The invention relates to a process for producing burr-free workpieces by blanking, in particular in a counterblanking tool, a blanking strip from which the workpiece is to be blanked being clamped between an upper and a lower blanking die and an upper and lower punch and blanking being effected by cooperation of an upper and a lower punch.

The blanking discussed here is a modification of a blanking procedure. Whereas, in blanking, a blanking strip is acted upon by a punch on one side, in fine blanking the blanking strip is clamped between a blanking die and a press plate, a punch and a pressure pad.

The quality of the cut surface of the workpiece is thereby considerably improved.

So-called fine counterblanking or fine counterstamping is furthermore also known, in which the blanking strip is clamped between two blanking dies and two punches. According to this method, a punch makes an initial cut in the workpiece counter to the pressure of the other punch, the pressure of this cutting punch exceeding that of the other punch.

After the initial cutting, there is a reversal of the pressure build-up, i.e. the pressure on the other punch exceeds the pressure which acted on the first punch which effected the initial cut. As a result, an initial cut is made in the workpiece from the other side.

Subsequently, there is then once more a reversal of the pressure build-up, i.e. the pressure of the first punch exceeds the pressure of the other punch, the workpiece thereby finally being blanked out.

A process of this kind is described, for example, in German Patent 2,727,445. A disadvantage of this process is that a separate workstation has to be provided for each operation in the fine blanking device and this makes the overall procedure slower and more expensive.

Furthermore, it has proven particularly disadvantageous that, as a result of the repeated pressure reversal, the device or elements of the device have to be stopped and their motion reversed. This means not only a considerable expenditure of energy but also the development of a special device suited specifically to fine counterblanking. In addition, the overall procedure is made slower.

The inventor has set himself the object of eliminating these disadvantages of the known fine counterblanking or counterstamping procedure and of developing a process which can be used in an already existing fine blanking press and, in particular, avoids a reversal of motion within this fine blanking press during a working stroke.

SUMMARY OF THE INVENTION

What leads to the solution of this object is the fact that, during a lifting procedure, an initial cut is made in the blanking strip in the contour of the workpiece and, during the same lifting procedure, the workpiece is blanked out in the opposite direction, burr-free workpieces thereby being produced.

A considerable advantage of the present process is that a reversal of motion no longer takes place in the fine blanking press during a lifting procedure. The entire fine counterblanking process requires only one workstation and only a single lifting procedure.

This lifting procedure is preferably carried out using a drive mechanism of the fine blanking press which moves a blanking die and a punch jointly with one lifting force. For the sake of simplicity, the basic drive mechanism of the fine blanking press itself is used here. Normally, a fine blanking press comprises a table and a ram. The table is often arranged above the ram, the ram thus being raised towards the table. The actual counterblanking tools, such as punch and blanking die, are in each case situated on the table and on the ram respectively. In the present case, both each blanking die and each punch should preferably be assigned a separate arrangement which subjects both each punch and each blanking die to a certain pressure irrespective of the actual lifting force of the drive mechanism of the fine blanking press, for example of the press ram. Five forces are at work. An appropriate hydraulic system with a hydraulic pressure medium is preferably provided for building up the pressures since this hydraulic pressure medium can be controlled and switched off or on at the correct time. This ensures maximum precision and productivity. Mechanical springs could also be used but these are afflicted with a force-displacement characteristic and are impossible or complicated to control. However, other possibilities for building up pressure are also intended to be encompassed by the present inventive idea.

Since the actual fine counterblanking takes place during the lifting procedure, the lifting force should be chosen to be greater than the sum of the pressures which acts on the blanking dies or the punches and carry out the actual process of fine counterblanking during the lifting procedure. In addition to this there is a certain cutting force for cutting the workpiece, this cutting force being the product of the length of the cutting line, the thickness of the material and the specific shearing resistance of the material.

Contrary to the fine counterblanking mentioned in the prior art, an actual initial cutting of the workpiece by a punch takes place in the present case in cooperation with the other punch while blanking out is effected by the further movement of the blanking dies along the punches during the lift.

In a first operation, one blanking die and one punch are moved towards the other punch and the other blanking die by the press hydraulics, i.e. the lifting force, until the blanking strip is clamped. By way of example, the pressure of the punch which has been raised now exceeds that of the other punch, which is situated in the other blanking die. On the other hand, however, the pressure which is acting on the other blanking die exceeds that to which the blanking die to be raised is subjected. In the further course of the lifting procedure, the punch subjected to a smaller force is therefore forced back as far as a stop while the raised blanking die remains stationary.

The punch is here forced back by an amount which corresponds to a fraction of the thickness of the workpiece. An initial cut is thereby made in the workpiece. Since, however, due to the stop, the forced-back punch now stops, this initial cutting procedure is also stopped, i.e. the cutting punch stops. In this instant, the raised blanking die, which has hitherto remained stationary due to the pressure of the resisting blanking die, has also reached a stop, with the result that the lifting force of the fine blanking press now exceeds the resisting force of the other blanking die. During the further lifting procedure, the blanking lattice is carried along and taken past both punches until the workpiece has been blanked out. The blanking procedure is complete and all pressures on the blanking dies and punches are switched off. The lifting force is likewise switched off, with the result that the ram on which the one blanking die and the one punch are situated is lowered. During this procedure, the blanked-out workpiece is situated in this blanking die while the blanking lattice remains on the other blanking die, around the punch situated there.

In the end position, the one punch then ejects the workpiece, while the opposite blanking die strips the blanking lattice from its punch. The blanking strip can now be moved along in the device and a subsequent lifting procedure or a fine counterblanking procedure can be begun.

In a corresponding device for producing burr-free workpieces by fine counterblanking from a blanking strip or the like which is clamped between an upper and a lower blanking die, blanking is effected in cooperation with an upper and a lower punch. Here, a machine drive with a lifting force for a unit comprising blanking die and punch .is provided, and both this blanking die and this punch, and the other blanking die and the other punch, are subjected to pressures.

The tool design operates with virtually the same upper and lower parts. Both blanking dies and both punches, which together effect the blanking procedure, can be identical. The tool design corresponds to an overall cut in which the workpiece is produced in one press stroke. The blanking procedure itself is effected with the material clamped at all times. In the present case, the machine is preferably a so-called quintuple-acting machine.

The fine blanking press ram carrying out the lift advantageously operates at a controlled, adjustable speed in order to take account of the particular materials and desired shapes of the parts. At the same time, the carrying out of the lifting procedure by the ram with adjustable speed means a longer life of the active cutting elements which effect the actual blanking procedure. The ram can operate downwards from above and also upwards from below.

In the rest position, i.e. in the starting position before a new lift, a punch maintains a clearance from a fixed insert ring or the like, which clearance can be altered towards zero under the pressure of the other punch. This clearance amounts to only a fraction of the thickness of the workpiece, it thus remaining guaranteed that the punch makes an initial cut in the workpiece only by the amount of the clearance. This fraction depends on the strength or properties of the material and its thickness.

Opposite, too, a corresponding clearance is provided at the other tool part. The opposite blanking die maintains this clearance. As soon as this blanking die has changed the clearance to zero, its pressure exceeds that of the resisting blanking die, with the result that initial cutting of the workpiece by the one punch ceases. For this reason, both clearances should preferably be the same.

The lifting procedure of the ram of the fine blanking press is ended when the blanking dies with the clamped-in blanking lattice have traveled a path corresponding to the amount made up of the depth of the initial cut of the workpiece and the thickness of the workpiece. After traveling this path during the lift of the ram, the workpiece has been blanked out of the blanking strip.

Each blanking die and each ram should preferably be assigned a corresponding annular piston in a pressure chamber, the desired pressure being built up in the respective pressure chamber.

The pressure which acts on the one punch is here less than the pressure acting on the other punch. In a reverse relationship, the pressure which acts on the one blanking die is less than that acting on the other blanking die. Of course, the force ratio always also includes the cutting force in addition.

Of course, the present inventive idea also includes the possibility that an initial cut is first of all made in the workpiece by the blanking dies by corresponding control of the pressures acting on the blanking dies and corresponding stops and that blanking out is effected by the punches during the further lifting procedure.

It should also be mentioned that the arrangement of the annular pistons and the overall design of the tool allows the annular pistons to operate as displacers, which perform their work under positive control, and no switching of any kind is therefore required during blanking. This is a positive control which is reliable in terms of production and operates without interruption. Such a principle even permits stroke sequences of well over 100 strokes per minute.

A normal triple-acting fine blanking press is used, which is provided with the additional two pressures and thus becomes a quintuple-acting fine blanking press.

This press can therefore be used both for normal fine blanking and for counterblanking.

The press thus constitutes a flexible production device.

BRIEF DESCRIPTION OF THE DRAWINGS

Further advantages, features and details of the invention emerge from the following description of preferred illustrative embodiments and with reference to the drawing, in which.

DETAILED DESCRIPTION

Figure 1:
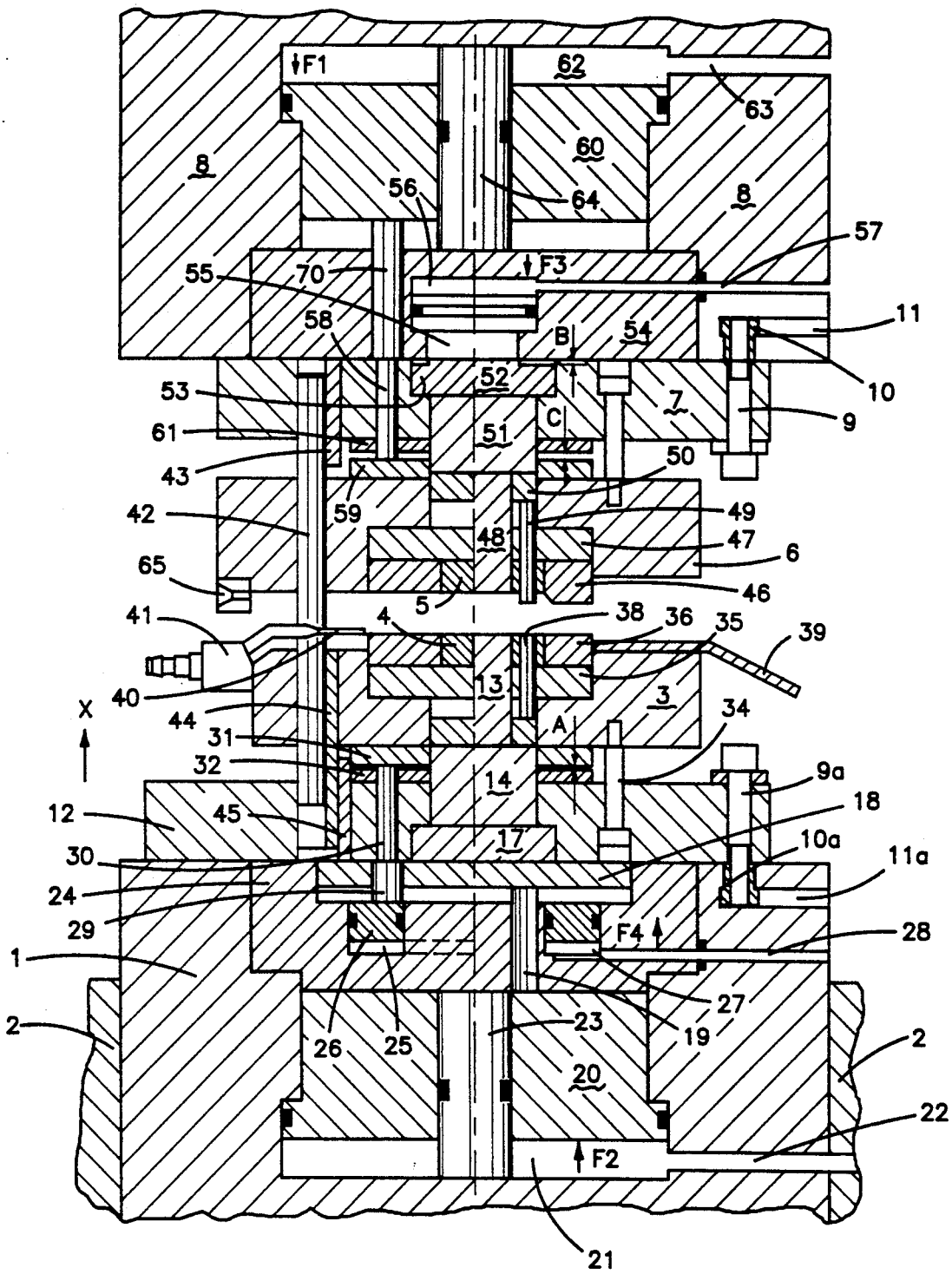
FIG. 1 shows two different longitudinal sections through a fine blanking press.

According to FIG. 1, a fine blanking press for fine counterblanking has a machine ram plate 1, which is guided in a ram guide 2. In this arrangement, the ram plate 1 can be raised in direction X in the ram guide 2.

Connected to the ram plate 1 is a guide plate 3, which accommodates the blanking die 4 as a lower tool part. Assigned to this blanking die 4 as an upper tool part is a further blanking die 5, which is situated on an upper guide plate 6. This upper guide plate 6 is connected to a die bolster 7, which hangs on a table plate 8. It is secured via a screw bolt 9 which engages in T-nuts which are fixed in a corresponding slot 11.

A lower die bolster 12 is fixed on the ram plate 1 in a manner comparable to the die bolster 7, likewise being fixed via screw bolts 9a which engage in corresponding nuts 10a guided in a slot 11a.

A punch 13 is guided in the lower blanking die 4. This punch 13 is seated on a punch guide 14, underlying which there is, in turn, a punch support plate 17. Finally, this punch support plate 17 is seated on a thrust bolt 19, which is connected to an annular piston 20. This annular piston 20 can be subjected by a pressure in a pressure chamber 21 to a force F2, the corresponding force F2 being built up hydraulically.

A corresponding oil feed and discharge is denoted by 22.

Passing through the annular piston 20 is a supporting bolt 23, which is seated at one end on the ram plate 1 in the pressure chamber 21 and at the other end supports an insert ring 24. The thrust bolt 19 is also guided in this insert ring 24 and also formed in it is an annular cylinder 25 in which an annular piston 26 is seated. Here too this annular piston 26 forms, together with the annular cylinder 25, a pressure chamber 27, which is supplied with a hydraulic medium via a feed and discharge line 28.

By means of the annular piston 26, a thrust bolt 29 which in turn passes through the pressure plate 18 can be moved. For this purpose, a force F4 acts in the pressure chamber 27. This force F4 is transmitted via the thrust bolt 29 to a further thrust bolt 30, which acts on a pressure disk 31. This pressure disk 31 underlies the guide plate 3 and, in the position shown, maintains a clearance A from a further pressure disk 32. This clearance A can be altered during the blanking procedure counter to the force F4. It becomes 0. Distance shoulder screws 34 are furthermore provided between the guide plate 3 and the die bolster 12.

A pressure plate 35 which surrounds the punch 13 is also set into the guide plate 3. On this pressure plate 35 there is also a platen 36 for the blanking die 4, the blanking die 4 being passed through by a thrust bolt 38.

Adjoining the platen 36 on the right is a guide sheet 39 for a finished workpiece, while the platen 36 is subjected on the left to compressed air from a nozzle 40 of a blast nozzle block 41.

For matching the position, the guide plate 3 and the guide plate 6 are connected to one another via guide pillars 42. In this arrangement, the guide pillars 42 pass through guide bushes 43 in the upper die bolster 7, guide bushes 44 in the guide plate 3 and guide bushes 45 in the lower die bolster 12.

Assigned to the lower blanking die 4 in the upper guide plate 6 is the upper blanking die 5, and an upper platen 46, adjoining which is an upper pressure plate 47, is assigned to the platen 36. Blanking die 5 and pressure plate 47 are passed through by a punch 48, which is assigned in turn to the punch 13. Similarly to the thrust bolt 38, a thrust bolt 49 is also provided next to the punch 48, said thrust bolt 49 being supported at one end against a punch holding plate 50 and at the other end projects beyond the punch 48 by the amount of the thickness d of a blanking strip 66. This punch holding plate 50 rests against a punch guide 51, which is arranged below a punch support plate 52. By means of a shoulder 53, this punch support plate 52 maintains a clearance B from an upper insert ring 54, which is inserted into the table plate 8. This clearance B can be altered counter to the pressure of a piston 55 which slides in a pressure chamber 56 within the insert ring 54. In the pressure chamber 56, a pressure F3 is built up or reduced by feeding in or discharging a hydraulic medium via the line 57.

In a manner corresponding to the guide plate 3, the upper guide plate 6 is also acted upon by a thrust bolt 58, which is connected on the one hand, via a pressure disk 59, to the upper guide plate 6, while, at the other end, it is acted upon, with the interposition of a bolt 70, by an annular piston 60. In the case of a pressure on the upper guide plate 6, a clearance C between the pressure disk 59 and a further pressure disk 61 resting against the die bolster 4 can thereby be reduced. This takes place counter to the pressure in a pressure chamber 62, into which a hydraulic medium can be introduced via the line 63, enabling a force F1 to act here. A supporting bolt 64 also passes through the annular piston 60. 65 indicates a guide for a blanking strip 66 shown in greater detail in FIGS. 2 and 3.

Since both blanking dies and punches are subject to wear and thus have to be reground, these elements as, for example, also the thrust bolts 38 and 49, are underlain by matching plates not shown in detail.

The process according to the invention is now described in greater detail with reference to FIGS. 2 and 3. In a continuous ram stroke in accordance with FIG. 2a), the ram plate 1 is driven upwards, with the result that the blanking strip 66 is clamped between the lower blanking die 4 and the upper blanking die 5 and between punches 13 and 48. This driving upwards is effected by the hydraulics of the fine blanking press, which are not shown in detail. During this procedure, a lifting force F is acting which is greater than the pressure F1+force F2+force F3+force F4+cutting force $F_s$, the latter indicating the force which is required to blank out a workpiece from the blanking strip 66. The force F2 furthermore acts in pressure chamber 21 and the force F4 acts in pressure chamber 27.

Figures 2A, 2B, 2C, 2D, 2E:
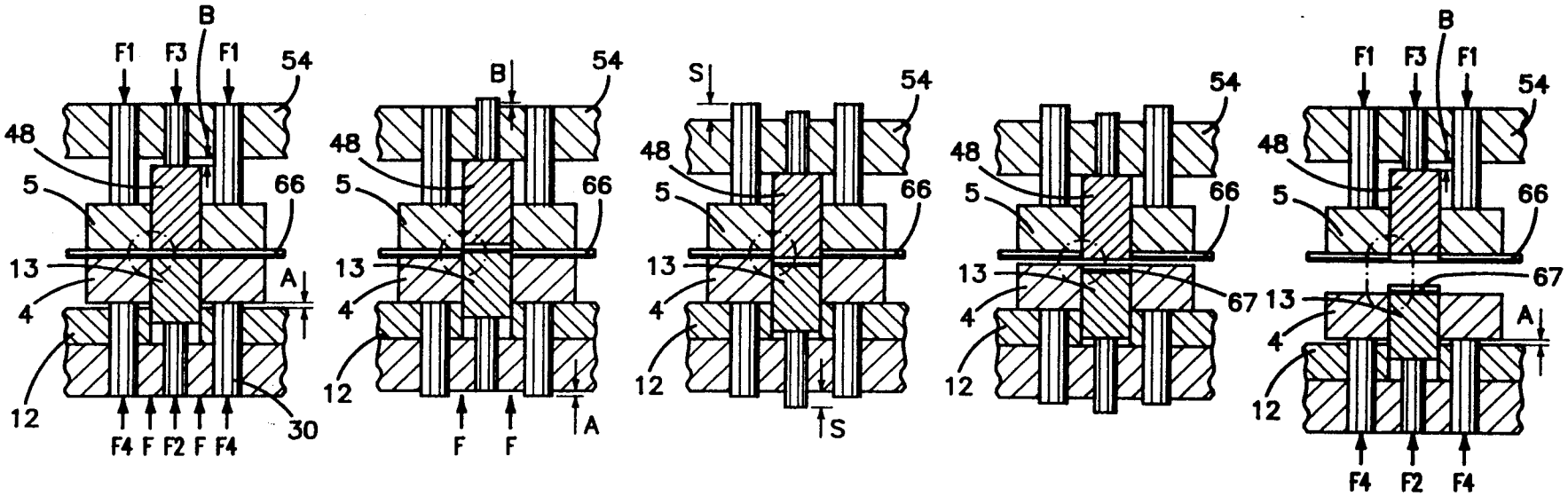
FIGS. 2(*a*)–2(*e*) show a schematic representation of the course of a process according to the invention for fine counterblanking, in different working stages a–e.

The ram plate 1 then travels further with a force F, more precisely by the amount of the clearance B, as indicated in FIG. 2b). During this procedure, the pressure F2 in pressure chamber 21 is maintained, this pressure F2 exceeding the cutting force F, and the force F3 in pressure chamber 56. This means that the punch 48 travels back by the amount B until the punch support plate 52 comes to rest against the insert ring 54. A corresponding quantity of hydraulic medium flows away out of the pressure chamber 56 via the line 57.

Furthermore, the blanking die 4 is moved relative to the lower die bolster 12, the annular piston 26 travelling back into the annular cylinder 25 and the pressure F1 overcoming the force F4. This continues until the pressure disk 31 comes to rest against the pressure disk 32 and the clearance A is eliminated. In contrast, the thrust bolt 29 now exhibits a corresponding clearance A from the undersurface of the lower die bolster 12. By means of this working step, an initial cut is made in the blanking strip 66.

The ram plate 1 travels on without interruption, as indicated in FIG. 2c) for the lower die bolster 12. During this procedure, the blanking die 4 is taken along while the lower punch 13 remains stationary. This occurs because the upper punch 48 or its punch support plate 52 rests against the insert ring 54, with the result that a further yielding of the upper punch 48 can no longer occur. The upper blanking die 5, in contrast, is forced back counter to the force F1 by an amount S which permits the blanking strip 66 to be cut through.

During this procedure, the force F1 is greater than the cutting force F, and the force F4. The latter is cancelled at that moment since the lower blanking die 4 has come to a standstill due to the fact that the guide plate 3 is resting against the lower die bolster 12.

This movement has the effect that the blanking strip 66, in which an upward initial cut has hitherto been made by the amount A, is cut through completely downward into the blanking die 4 by the punch 48 in the opposite direction. This occurs moreover counter to the pressure F2 which is acting in the pressure chamber 21 for the punch 13.

During this procedure, a clearance is maintained between the punches 13 and 48 by the thrust bolts 38 and 49, specifically by the amount of the thickness d of the blanking strip 66.

In this position of the tool, the fine counterblanking procedure is complete. The forces F1, F2, F3 and F4 acting in the individual pressure chambers are switched off and the ram plate 1 travels back. It can be seen from FIG. 2*d*) that the cut workpiece 67 lies in the blanking die 4 while the remainder of the blanking strip 66 hangs on the upper punch 48.

In the position of the counterblanking tool shown in FIG. 2*e*), the pressures F1, F2, F3 and F4 are now built up in the individual pressure chambers, thus enabling the punch 48 to reassume its clearance B from the insert ring 54.

At the same time, via the pressure F1, the upper blanking die is moved downward by the amount C, which is greater than the clearance B. The blanking die 5 thus slides further downward relative to the punch 48, the blanking strip 66 thereby being stripped off.

Due to the pressure build-up F4, the clearance A between the blanking die 4 or its guide plate 3 and the lower die bolster 12 is furthermore reestablished. This occurs relative to the lower punch 13, the latter thus acting as an ejector for the workpiece 67. This workpiece 67 is blown out by the blast nozzle 40.

Figures 3A, 3B, 3C, 3D, 3E:
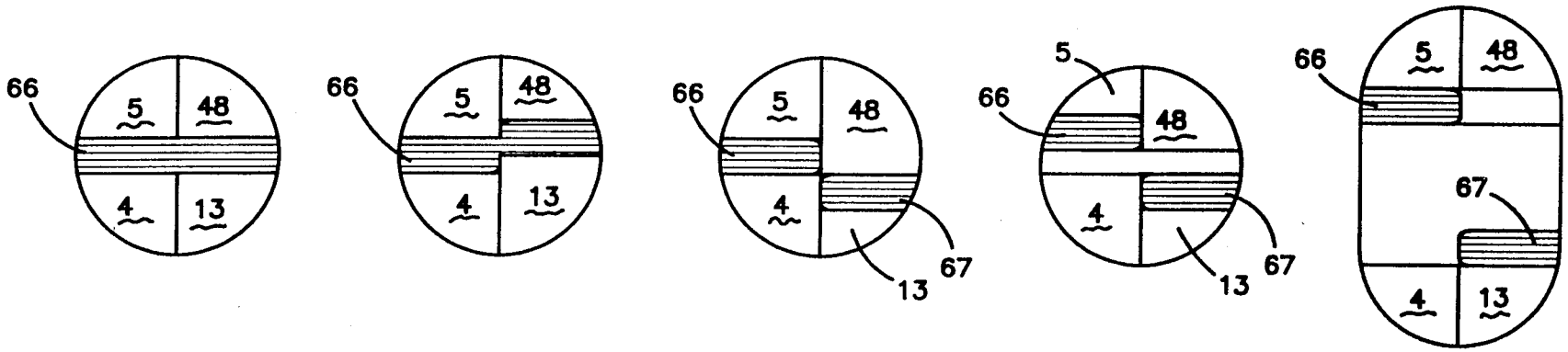
FIGS. 3(*a*)–3(*e*) show details, represented on an enlarged scale and pertaining to FIG. 2, of a counterblanking tool in the region of the processing of the workpiece.
Figure 7:
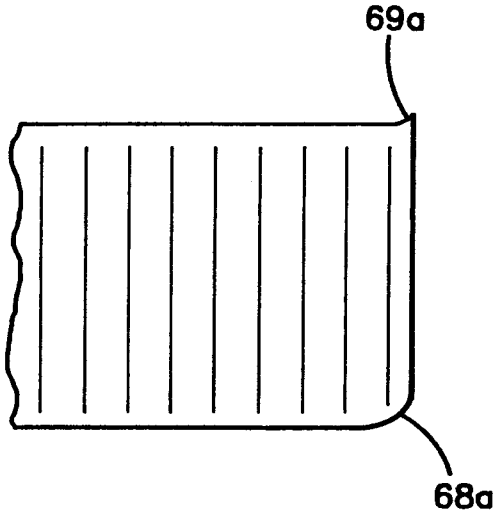
FIG. 7 shows a partially illustrated cross-section through a workpiece processed by the fine blanking process.
Figure 6:
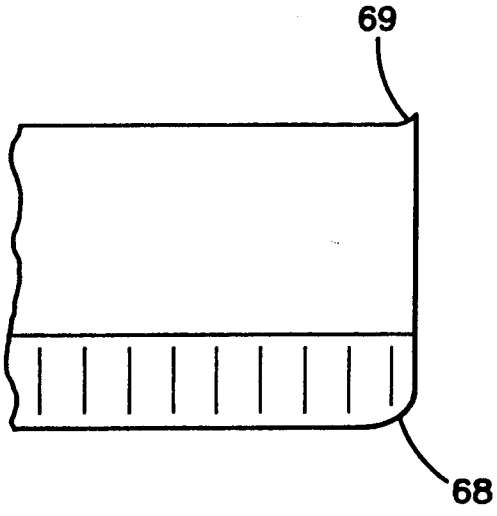
FIG. 6 shows a partially illustrated cross-section through a workpiece processed by the normal blanking process.

An advantage of the process according to the invention can be seen particularly in FIG. 3. While, in a normal blanking process according to FIG. 6, a drawn-in portion 68 of the blanked edge and, on the other hand, a burr formation 69 occurs, the formation of which is merely moderated in normal fine blanking according to FIG. 7, a drawn-in portion **68*b* and 68*c* of the blanked edge occurs on both sides in fine counterblanking. That is to say, workpieces 67 without any blanking burr 69** ar produced.

Figure 8:
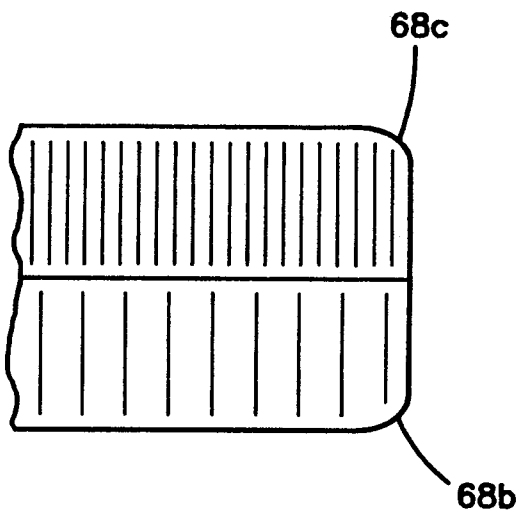
FIG. 8 shows a cross-section, represented on an enlarged scale, through a workpiece processed by the fine counterblanking process.

In normal blanking, a drawn-in portion of the blanked edge and a burr are formed on the workpiece. Between them there is a smooth cut surface and a fracture or tearing surface. In fine blanking, a smooth cut surface is produced over almost the entire thickness of the workpiece, as indicated by the vertical lines. By means of fine counterblanking, on the other hand, symmetrical influencing of the cut surface takes place, as can be seen from FIG. 8. Drawing-in of the edge occurs on both sides and smooth cut surfaces are formed from both top surfaces. Burr formation no longer occurs at all.

Figure 4:
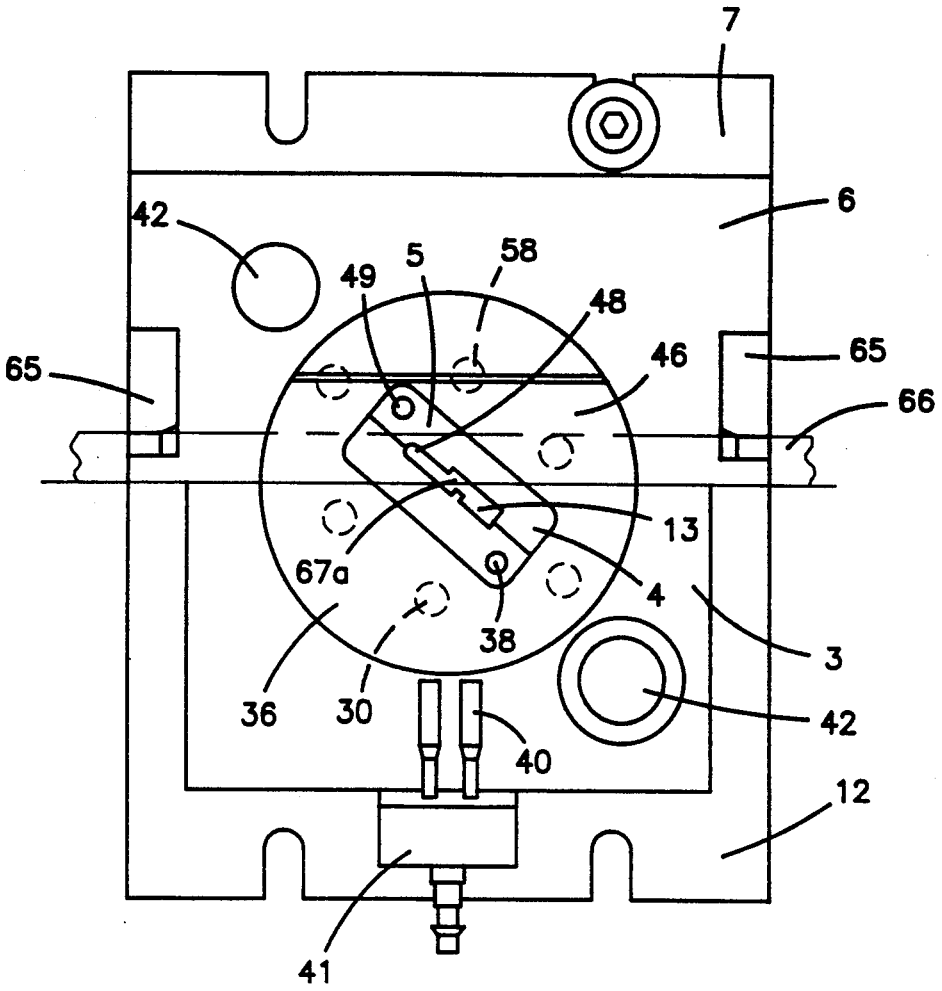
FIG. 4 shows a plan view of a tool part.

In FIG. 4, the production of a needle-shaped workpiece **67*a*** is illustrated by way of example.

Figure 5:
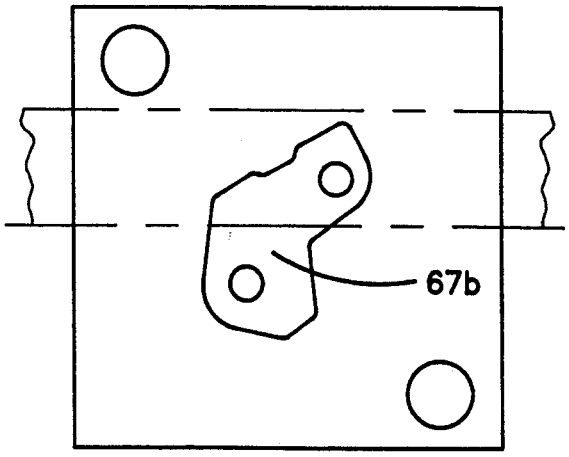
FIG. 5 shows a plan view of a further tool part, by means of which parts with internal shapes are produced.

In FIG. 5, the production of a part with two internal shapes, in this case round holes, which can also have any other desired shape, is illustrated, part **67*b***.

In the upper half of FIG. 4 a bottom view of the upper part of the counterblanking tool is shown, in particular with the upper guide plate 6 and the upper die bolster 7. The lower half of FIG. 4 represents a plan view of the lower part of the counterblanking tool, in particular with the guide plate 3 and the die bolster 12. Also indicated are the guide pillars 42 and the blast nozzle block 41 with nozzle 40.

In this illustrative embodiment, a needle is to be produced, but, of course, differently shaped workpieces can also be produced in a very simple manner, such as, for example, in FIG. 5, a part **67*b*** with two holes.

The tool frame with die bolster 12 and guide plate 3 or 6 and 7 respectively can have any desired shape. Likewise, the blanking dies 4 and 5 can be divided, of one piece, round, angular or comprise other shapes. A similar statement applies also to the platens 36 and 46. The platens 36 and 46 can be accommodated in a recess, as shown, or be placed on the corresponding guide plates 3 and 6 respectively.

The thrust bolts 58, 70 and 29, 30 should always be arranged around the punch 13 and 48 respectively, to ensure that optimum support remains guaranteed.

Instead of the screw bolts 9 cooperating with the nuts 10 it is also possible for a quick change attachment, as shown, for example, in European Patent 0,201,456, to be provided.

Any material can be cut, whether steel, heat-treated steel, hardenable stainless steel, aluminum or its alloys, copper or even plastics, such as, for example, fiber-reinforced plastics. Work can be carried out with or without a knife-edged ring. Any shape contour of the parts is possible, with or without internal shapes. The material thicknesses are from 0.2 to 8.0 mm and above. All of this is encompassed by the present inventive idea.

It is to be understood that the invention is not limited to the illustrations described and shown herein, which are deemed to be merely illustrative of the best modes of carrying out the invention, and which are susceptible of modification of form, size, arrangement of parts and details of operation. The invention feather is intended to encompass all such modifications which are within its spirit and scope as defined by the claims.

I claim:

1. A process for producing burr-free workpieces by blanking using a counterblanking tool with an upper tool and a lower tool which include respectively an upper blanking die and a lower blanking die and an upper punch and a lower punch and which further includes a ram plate which moves one of said upper and lower tools towards the together of said upper and lower tools, wherein said ram plate moves in a continuous ram stroke, said process comprising:

(a) clamping a blanking strip from which a workpiece is to be blanked between the upper tool and the lower tool;

(b) keeping the blanking dies in a place and causing a first one of said upper and lower punches to travel in a first direction and a second one of said upper and lower punches to travel back along said first direction until said second one of said upper and lower punches reaches a first limit stop, during said travel said first one of said upper and lower punches cutting partly into the blanking strip;

(c) applying a force after movement of said upper and lower punches stops and while said upper and lower punches are stationary such that a first one of said upper and lower blanking dies travels against a second limit stop and pushes the other of said upper and lower blanking dies so that aid upper and lower dies slide along the upper and lower punches and the second one of said upper and lower punches cuts the workpiece out from the blanking strip;

(d) stopping and reversing the ram stroke of said ram plate so that the upper and lower tools are separated; and (e) pushing the workpiece out of said counterblanking tool.

2. A process as claimed in claim 1 further comprising causing said first one of said upper and lower blanking dies and said first one of said upper and lower punches to move jointly by using a lifting procedure wherein a drive mechanism moves said first one of said upper and lower blanking dies and said first one of said upper and lower punches jointly with one lifting force.

3. A process as claimed in claim 2 wherein said steps (b) and (c) comprise applying separate, controllable pressures which act on each of said upper and lower blanking dies and on each of said upper and lower punches.

4. A process as claimed in claim 3 wherein said steps (b) and (c) further comprise applying said one lifting force so that it has a magnitude which is greater than a sum of the pressure which act on said upper and lower blanking dies and said upper and lower punches plus a cutting force needed to cut the workpiece.

5. A process as claimed in claim 4 wherein said step (b) further comprises causing a first pressure to act on aid first one of said upper and lower punches and causing a second pressure to act on said second one of said upper and lower punches said first pressure being greater than said second pressure plus said cutting force.

6. A process as claimed in claim 5 wherein said step (c) further comprises causing a third pressure to act on the first one of said upper and lower blanking dies and a fourth pressure to act on a second one of said upper and lower blanking dies, said third pressure being greater than said fourth pressure plus said cutting force.

7. A process as claimed in claim 2 wherein applying said one lifting force causes said first one of said upper and lower blanking dies and said first one of said upper and lower punches to move towards the second one of said upper and lower blanking dies and the second one of said upper and lower punches and further causes displacement of the first one of said upper and lower punches in the lifting direction with respect to the second one of said upper and lower punches by an amount of a fraction of the thickness of the workpiece, said displacement continuing until the second one of said upper and lower punches reaches said limit stop whereby said blanking strip is brought along in the lifting direction by the upper and lower blanking dies.

8. A process as claimed in claim 2 wherein applying said one lifting force causes the first one of said upper and lower blanking dies and the fist one of said upper and lower punches to move towards the second one of said upper and lower blanking dies and the second one of said upper and lower punches and further causes displacement of the first one of aid upper and lower blanking dies in the lifting direction and displacement of the second one of the upper and lower blanking dies by an amount of a fraction of the thickness of the workpiece until a stop is reached whereby the workpiece is then blanked out by said second one of said upper and lower punches.

* * * * *